US005692857A

United States Patent [19]

Ness

[11] Patent Number: 5,692,857

[45] Date of Patent: Dec. 2, 1997

[54] LIFTING FLOORS

[76] Inventor: Stewart D. Ness, 964 Brewster La., Rockledge, Fla. 32955

[21] Appl. No.: 531,402

[22] Filed: Sep. 21, 1995

[51] Int. Cl.[6] ..... B63C 3/06

[52] U.S. Cl. ..... 405/3; 114/44

[58] Field of Search ..... 405/3, 4, 7; 114/45, 114/48

[56] References Cited

U.S. PATENT DOCUMENTS

| | | | |
|---|---|---|---|
| 3,841,441 | 10/1974 | Klinkhammer et al. | 187/1 R |
| 3,857,248 | 12/1974 | Rutter | 61/65 |
| 4,104,082 | 8/1978 | Boujard et al. | 134/141 |
| 4,195,948 | 4/1980 | Vancil | 405/3 |
| 4,251,993 | 2/1981 | Vancil | 60/537 |
| 4,432,664 | 2/1984 | Baldyga | 405/3 |
| 4,773,346 | 9/1988 | Blanding et al. | 114/45 |
| 4,783,067 | 11/1988 | Montgomery | 405/3 |
| 4,791,885 | 12/1988 | Sandlofer | 119/96 |
| 4,900,187 | 2/1990 | Uchida et al. | 405/3 |
| 4,976,211 | 12/1990 | Reinhardt | 405/3 X |
| 5,099,778 | 3/1992 | Palen | 114/45 |
| 5,427,471 | 6/1995 | Godbersen | 405/3 |
| 5,522,671 | 6/1996 | Keesling | 405/3 |

*Primary Examiner*—Tamara L. Graysay
*Assistant Examiner*—Frederick L. Lagman
*Attorney, Agent, or Firm*—Brian S. Steinberger; Law Offices of Brian S. Steinberger

[57] ABSTRACT

Single acting water hydraulic cylinders are used to raise floor platforms in aquatic environments. A first cylinder with a vertically raisable piston is positioned on one side of a platform while a second cylinder with a vertically raisable piston is positioned on an opposite side of the platform. Each cylinder controls two corners of the platform through wire ropes that pass through plural sheaves. The single acting water hydraulic piston can use city water pressure to raise the platform, while three way valves allow gravity to allow the platforms to be lowered. The platforms can include a grid type grate that can be used to raise and lower marine mammals (i.e. whales, dolphins, manatees, walrus), aquatic animals (i.e. hippo) and marine fishes (i.e. sharks, stingrays) from an artificial habitat such as as a park pool. The platform can alternatively be fired with pivotable pads for lifting vessels such as small crafts from slips. The cylinders can be positioned on the top side edges of a pool, to the surface of a dock or the top surface of a pier. A still another version incorporates a mounting platform that allows the cylinders to be supported on the seafloor itself.

18 Claims, 9 Drawing Sheets

LIFTING FLOORS

This invention relates to a lifting floor, an in particular to using two pressurized water supply pistons for lifting and lowering marine animals and small craft in marine environments.

BACKGROUND AND PRIOR ART

Current systems are inadequate for raising and lowering both aquatic animals and marine vessels. Large park animals such as marine mammals (i.e. whales) and hippos usually need to be removed from artificial habitats for medical care and/or when the habitat needs to be serviced. Traditionally, pulley and winch systems use cables and ropes to move platforms and further use harnesses and/or stretchers to restrain the animals on the platforms. These systems can use up to four cables/ropes for attachment to each of the four corners of a platform. A handcrank is then needed for each of the chains. The handcrank systems are labor intensive in requiring up to four people for manning four handcranks that are needed to lift each of the four corners of a square type floor. Alternatively, the animal can be towed by the harness type attachment. See for example, U.S. Pat. No. 4,791,885 to Sandlofer. However, these harness, cables, ropes and winch assemblies can cause serious harm to the animals. More particularly, harness, cable and rope attachments can be painful and cause injuries to the animals, and involve extended periods of time when immediate access is critical.

Current watercraft lifting devices have many deficiencies for lifting marine animals. Many systems require a four post type arrangement where lifting pistons must be positioned at each of the four corners of a rectangular frame. See for example: U.S. Pat. Nos. 4,773,346 to Blanding et al. and 5,099,778 to Palen. All four pistons in these devices must be identically synchronized to operate simultaneously in order to equally lift each of the four corners at the same rate and speed. If only one corner is not synchronized then a craft being lifted is in danger of slipping and falling from the lifting device causing disastrous results.

Side lifting platforms have also been created where at least one side or corner of a frame is raised or lowered. See for example, U.S. Pat. Nos. 3,841,441 to Klinkhammer et al; 3,857,248 to Rutter; 4,104,082 to Boujard et al.; and 4,900,187 to Uchida et al. However, each of these devices is dependent on the difficult, time consuming and costly mechanical fixed connections to the sides of fixed supports such as docks and piers.

Other lifting devices require elaborate plumbing an construction costs. See for example U.S. Pat. Nos. 4,195,948 and 4,251,993 to Vancil. In both of these two systems, cylinders are required to deeply buried in a seal floor location. Such devices can be inadequate and prohibitively expensive in deep water locales and/or locales that have rock and concrete flooring below the water.

Thus, the need exists for adequately lifting and raising animals and vessels on platforms from marine environments that avoids the problems of the prior art referred above.

SUMMARY OF THE INVENTION

The first objective of the present invention is to provide an immediate, safe and humane system for raising and lowering marine animals from water habitats.

The second object of this invention is to provide a simplistic lifting system having dual hydraulic cylinders with pistons to raise and lower a platform in a marine environment.

The third object of this invention is to provide a hydraulic platform that can lift up to approximately 10,000 pounds or more using average city water pressure.

The fourth object of this invention is to provide a hydraulically raisable platform that relies on gravity to lower the platform.

The fifth object of this invention is to provide dual hydraulic cylinders that operate simultaneously when lifting and lowering a platform in a marine environment.

The sixth object of this invention is to provide a hydraulically raisable platform that can be used to raise and lower marine animals and marine vessels.

The seventh object of this invention is to provide a marine hydraulic lift system that does not require electricity nor electrical equipment and thus eliminates electrical shock hazards.

The eighth object of this invention is to provide a lifting system for marine environments having no operation noise to disturb nor cause stress to animals using the lifting system.

Further objects and advantages of this invention will be apparent from the following derailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
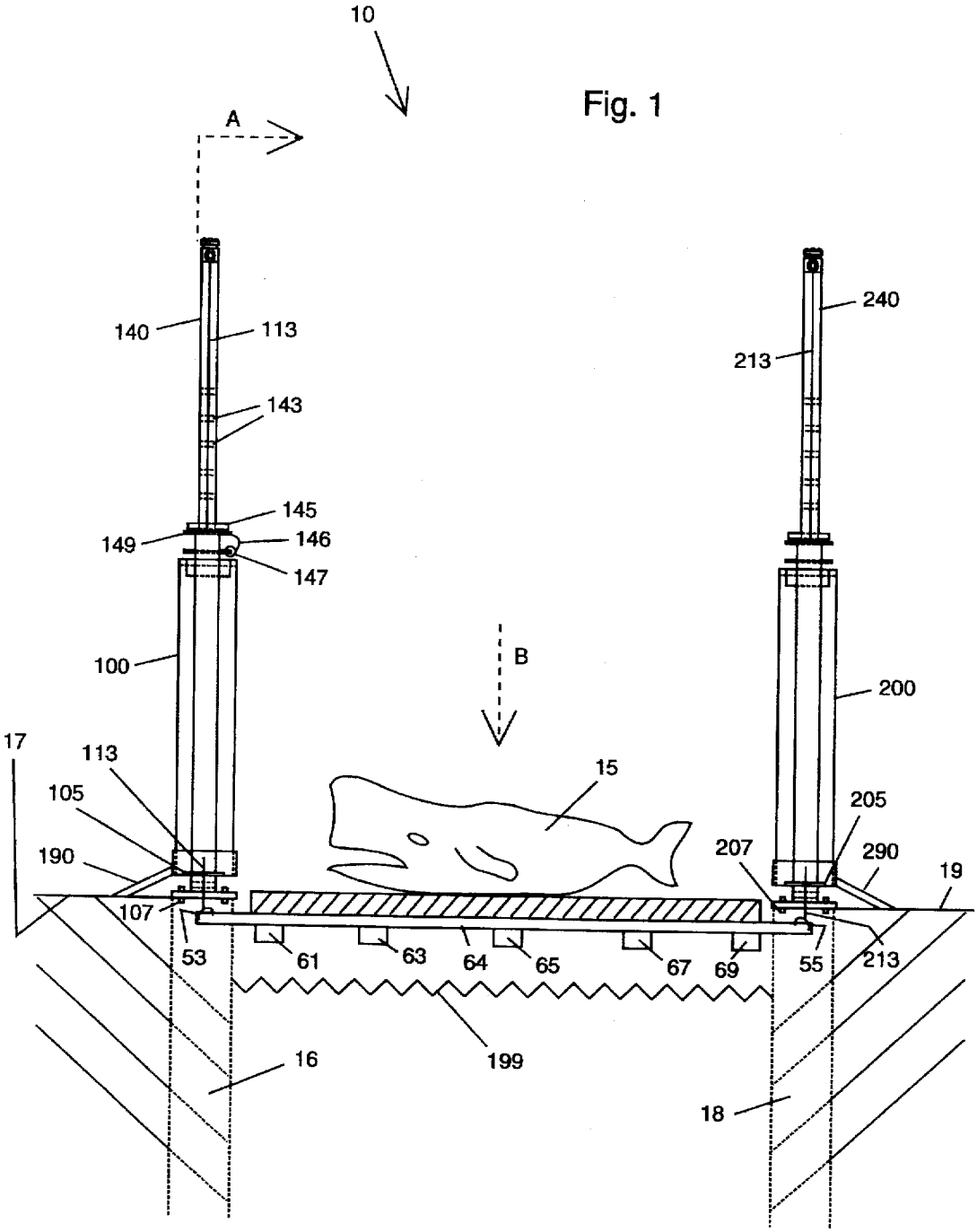
FIG. 1 is a side view of a first preferred embodiment of the lifting floor used for a marine animal.
Figure 2:
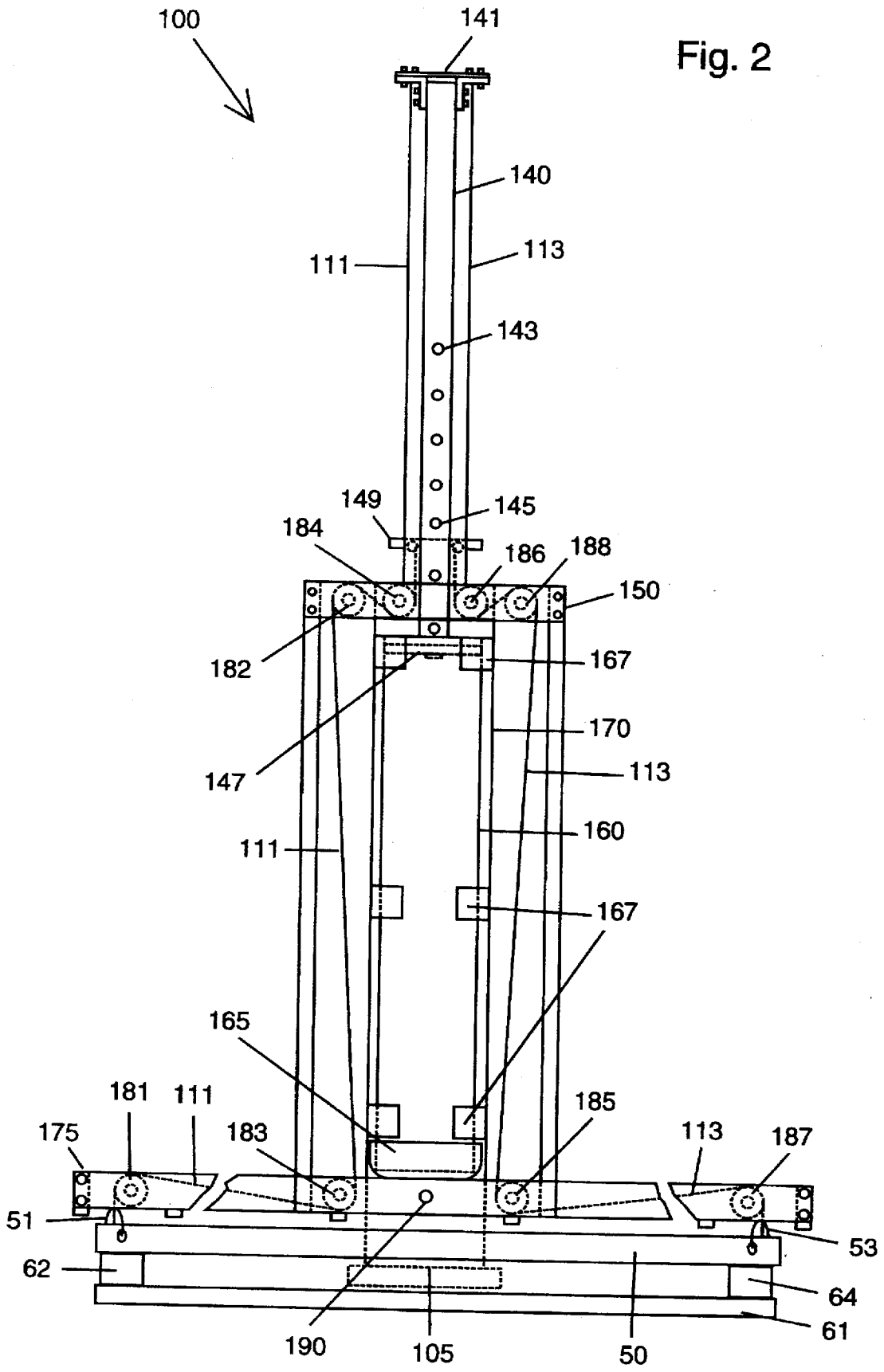
FIG. 2 is a cross-sectional view of the left lifting cylinder of FIG. 1 along arrow A with the platform in a raised position.
Figure 3:
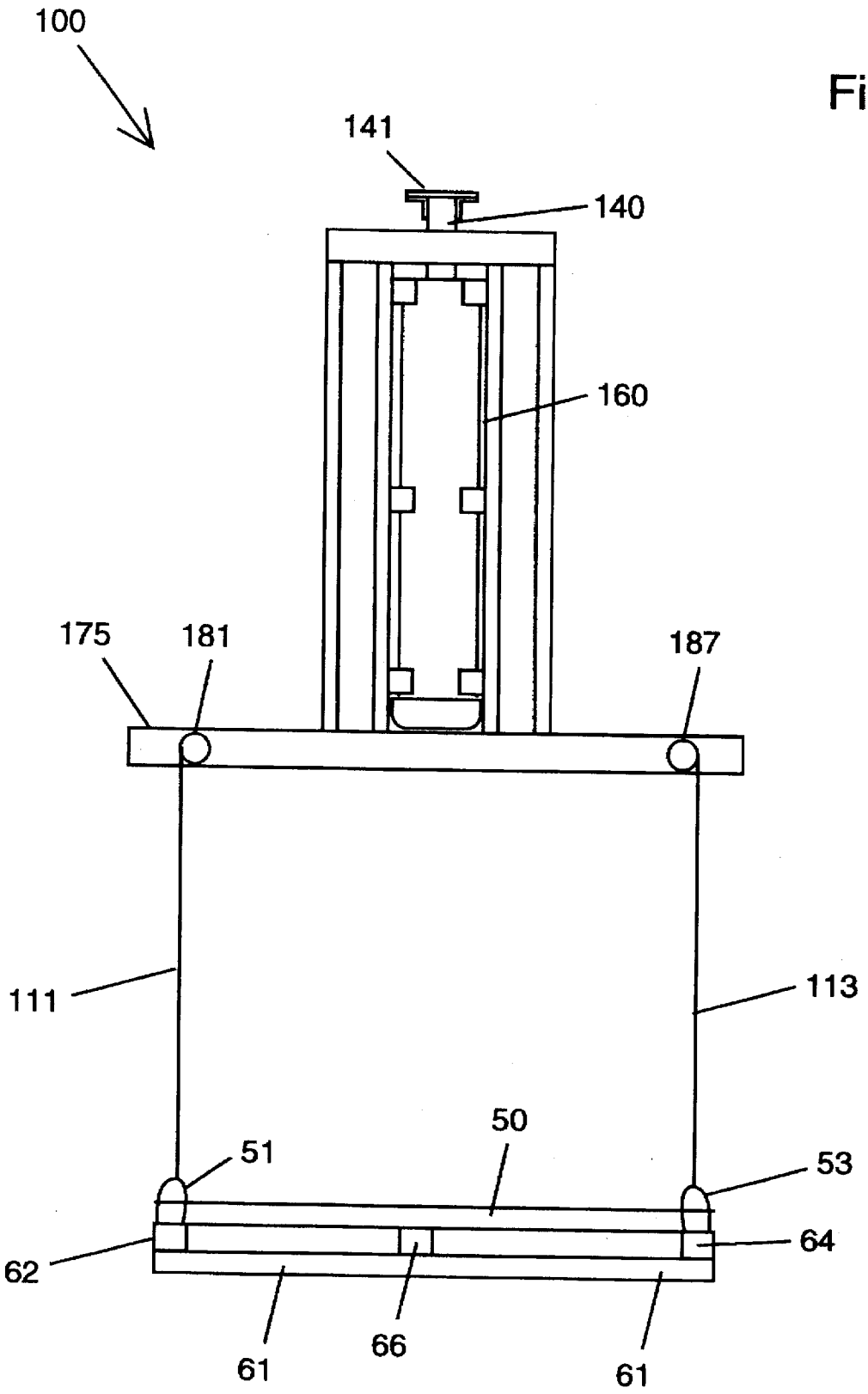
FIG. 3 is a view of the left lifting cylinder of FIG. 2 with the platform in a lowered position.

FIG. 1 is a side view of a first preferred embodiment 10 of the lifting floor 50 used for a animal 15 such as a marine mammal (i.e. whales, dolphins, manatees, walrus), aquatic animals (i.e. hippo), marine fishes (i.e. sharks, stingrays), and the like. In FIG. 1, floor 50 is raised above water level 199, and will be discussed in greater detail in reference to FIGS. 5 and 6. Referring to FIG. 1, floor 50 is supported by four corner brackets 51, 53, 55, 57 to respective cable ends 111, 113, 211, 213 (note only brackets 53, 55 and cable ends 113, 213 are shown in the front side view of FIG. 1). The floor 50 is raised and lowered by single acting water hydraulic cylinders 100 and 200, respectively. FIG. 2 is a cross-sectional view of the left single acting water hydraulic cylinder 100 of FIG. 1 along arrow A with the platform 50 in a raised position. FIG. 3 is a view of the left single acting water hydraulic cylinder 100 of FIG. 2 with the platform in a lowered position.

Referring to FIGS. 1–3, the base cylindrical supports 105 and 205 of cylinders 100 and 200 are attached by respective bolt type fasteners 107, 207 to the top edges of concrete type pool walls 17, 19 that can be part of an artificial habitat such as an aquarium and the like. Corner edges 16 and 18 are cut-out channels that allows ends of horizontal member 64 to pass beneath the cylinders 100 and 200. Single acting water hydraulic cylinders 100 and 200 each include vertically raisable pistons 140 and 240 respectively, the latter that can be a four inch by four inch square aluminum tube. Utilizing a reciprocating piston rod having a square cross-sectional shape instead of a cylindrical piston in a square housing eliminates rotation of the piston rod relative to the housing. Using pistons and respective housings having cross-sectional shapes other than cylindrical eliminates rotation and allows for minimum components in the framing construction. Although only cylinder 100 is shown in greater detail in FIGS. 2–3, cylinder 200 includes a like number of similar functioning components. Piston 140 has various locking positions 143 that can be formed by through-holes through the piston rod itself. Each position can be of the piston can locked in place by inserting a metal pin 145 through a locking hole 143 above an external rim 149 formed about the base of the piston 140. Pin 145 can be attached by a flexible tether type line 146 made of rope, wire and the like to a permanently mounted retainer ring 147 mounted adjacent the external rim portion 149.

Referring to FIGS. 1–3 piston rod 140 fits into a lower cylinder housing 150 that can be formed from aluminium and the like. Piston end 147 fits inside a pipe 160 having a diameter of approximately 12 inches in diameter formed from material such as PVC and the like. PVC pipe 160 is supported circumferential by aluminum cylinder supports 167 within an aluminum channel 170. The lower portion of pipe 160 is closed off by a PVC cap 165 that can be attached by solvent welding and the like, to the pipe itself. Incoming pressure line 190 feeds pressurized water into the lower portion of the pipe 170 of cylinder 100 while line 290 feeds pressurized water into the lower portion of cylinder 200 and each will be described in greater detail with reference to FIG. 4. Top end 141 of piston red 140 is attached to wire type support ropes 111 and 113. Rope 111 is fitted to roll about nylaton sheave wheels 182 and 184 that are mounted adjacent to the top of cylinder housing 150 and further about nylaton sheave (pulleys) 181, 183 that are mounted within an aluminum channels having a tread plate cover 175. The lower ends of ropes 111 and 113 are respectively attached to corner brackets (i.e. U-bolts) 51 and 53 of platform floor 50 and 60, the latter of which will be discussed in greater detail in reference to FIGS. 5–6.

Figure 4:
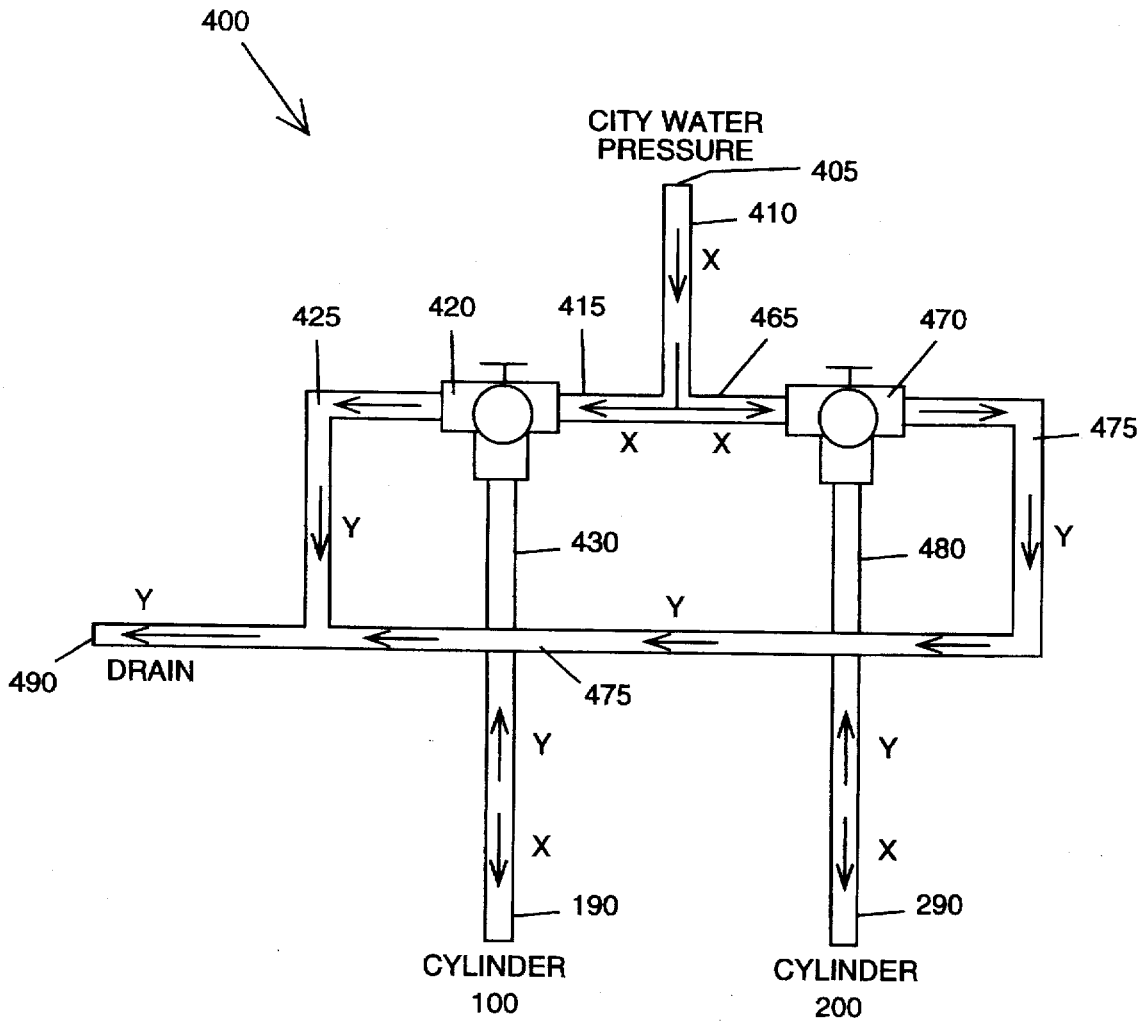
FIG. 4 illustrates the pressure valves and control lines used for the lifting cylinders of FIG. 1.

FIG. 4 illustrates the pressure valves and control lines 400 used for the lifting cylinders 100 and 200 of FIG. 1, which can be located below ground in the pool habitat walls 17 and 19 of FIG. 1. A pressurized water supply 405 such as city water and the like can supply pressurized water such as water having a 60 pounds per square inch of pressure into the system pipe 410 along arrow X and through a T-shaped connection which splits into respective lines 415 and 465. 3-way control valves 420 and 470 when turned on supply the pressurized water along the direction of arrow X through respective lines 430 and 480 and into the access openings 190 and 290 of respective cylinders 100 and 200. A second/center position for each of the 3-way valves 420 and 470 can close the valves. While third position of the 3-way valves can cause the pressurized water to flow out of lines 425 and 474 to an external drain location 490 that can be the actual drain of the water habitat of FIG. 1. Both the piping in the lines and the 3-way valves can be formed from material such as but not limited to PVC and the like. The control valves 420, 470 can be mounted adjacent to the lifting cylinders 100, 200 such as up from a floor location or out of an adjacent wall. A single operator can handle and control both valves 420, 470 simultaneously. The operator can visually watch the top ends of the pistons 140, 240 in order to determine the relative height of the platform floor 50.

Figure 5:
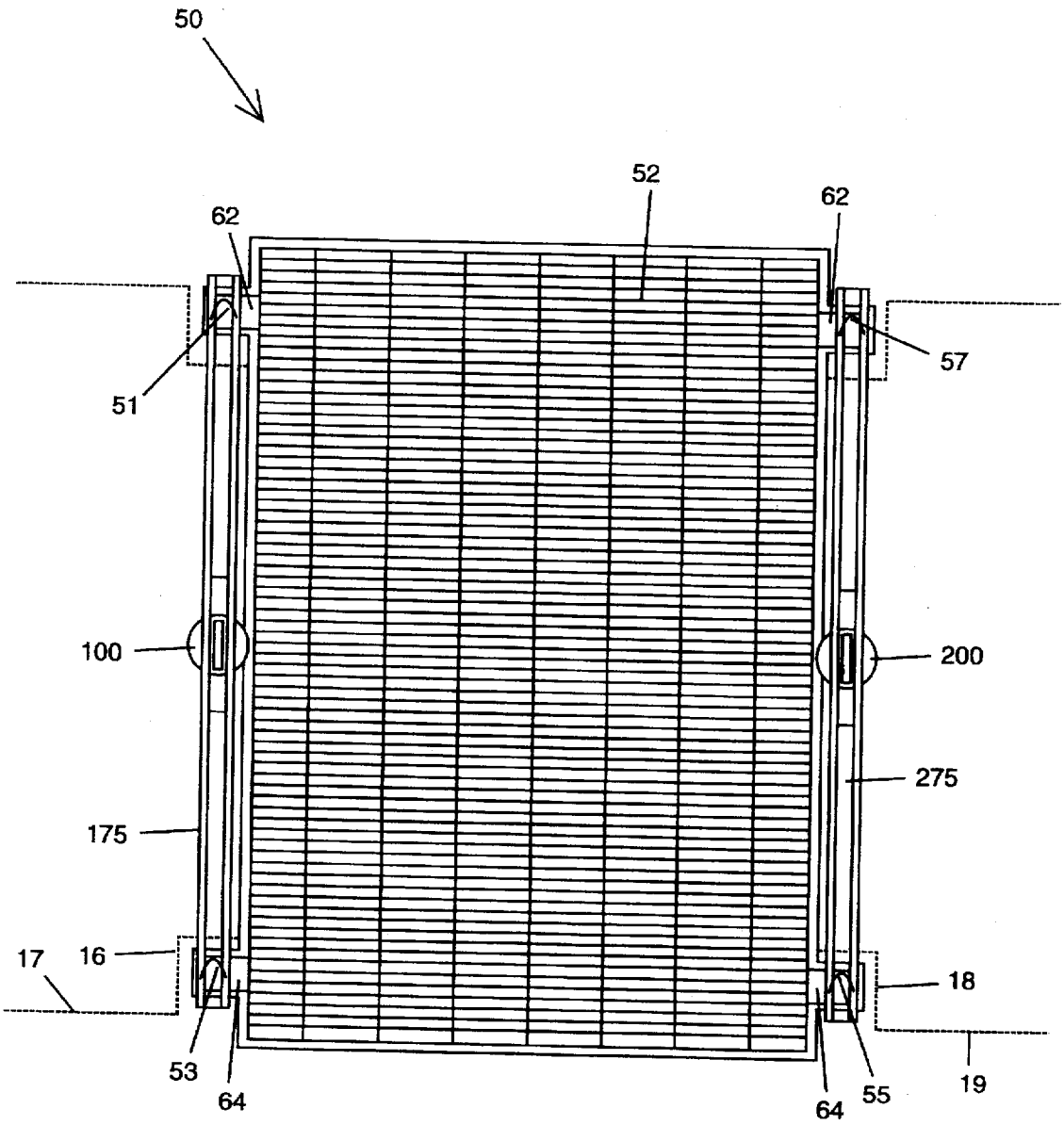
FIG. 5 is a top view of the lifting floor surface grating of FIG. 1 along arrow B.
Figure 6:
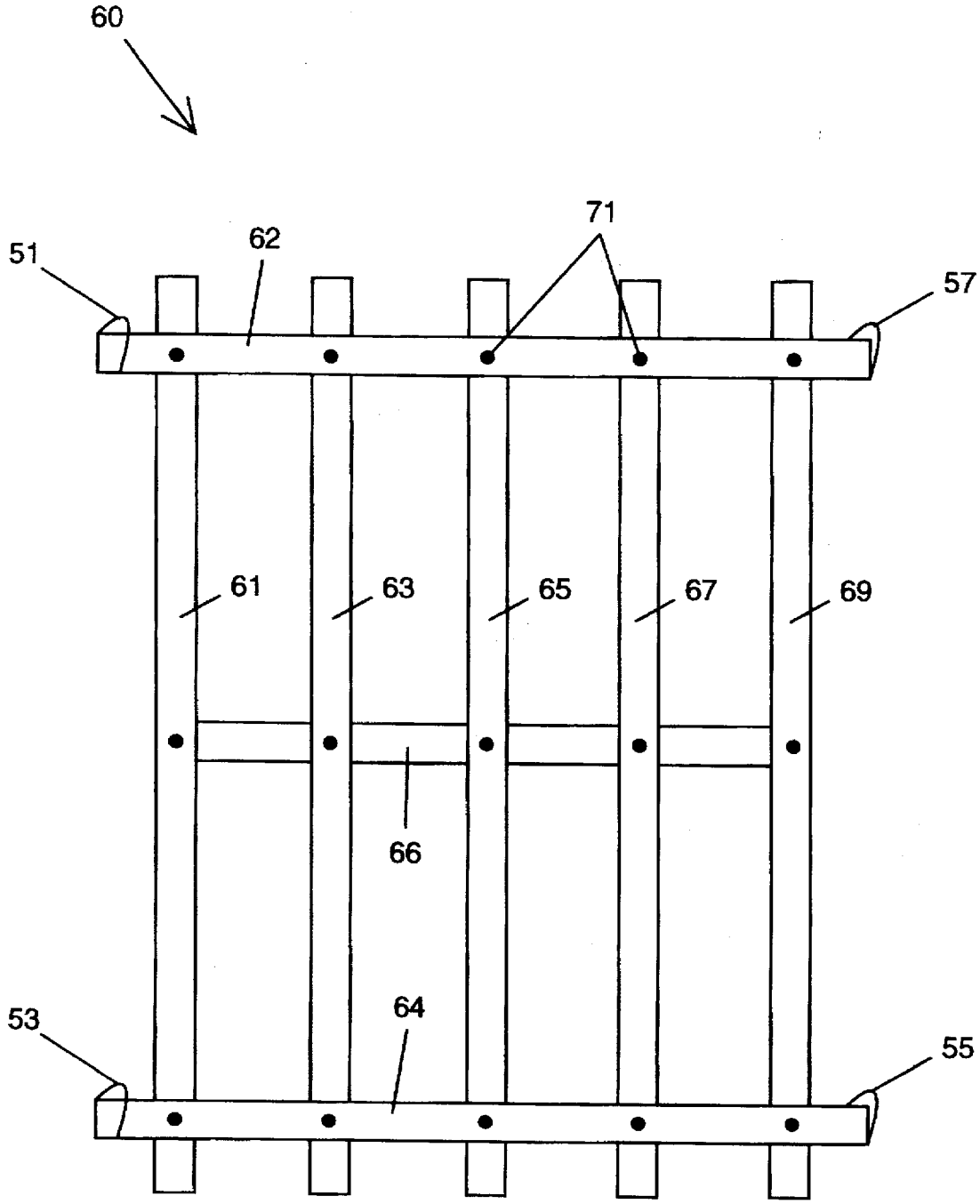
FIG. 6 is a top view of the lifting floor sub-frame of FIG. 5.

FIG. 5 is a top view of the lifting floor platform 50 of FIG. 1 along arrow B. Floor platform 50 includes a surface grid grating 52 that is supported on sub-frame 60 of FIG. 6. Four corner brackets 51, 53, 55, and 57 that can be U-bolts are attached to the ends of horizontal members 62 and 64 of the floor sub-frame 60 of FIG. 6. The sub-frame 60 includes fiberglass pultrusions 61, 63, 65, 67, and 69 that are joined by fasteners such as stainless steel bolts 71 and the like to horizontal members 62, 64 and 66, respectively. Both the grid grating 52 and the fiberglass sub-frame 60 have openings for allowing water to pass therethrough when raised or lowered through the water 199 of FIG. 1.

Figure 7:
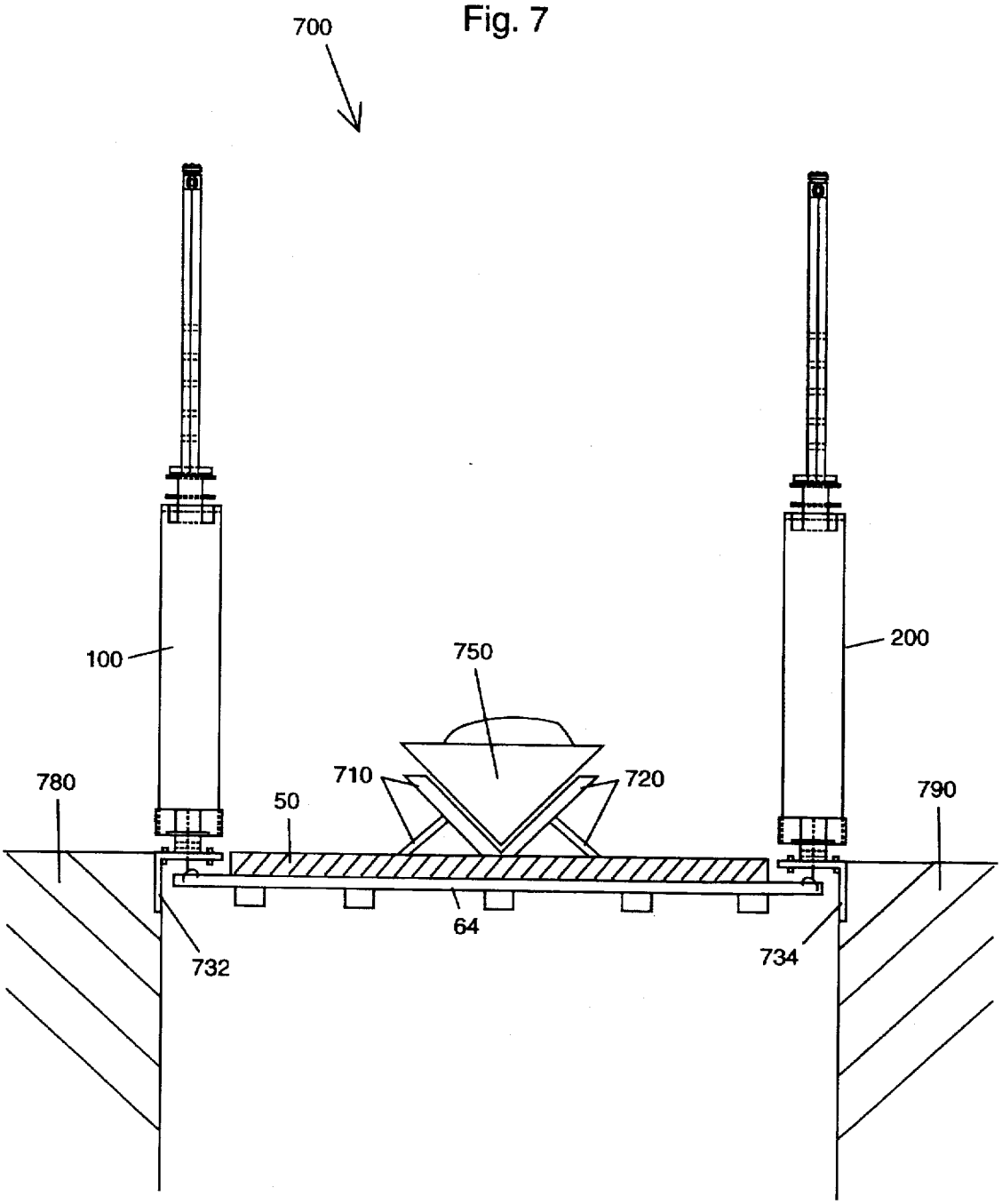
FIG. 7 is a side view a second preferred embodiment of the lifting floor used for marine vessels.

FIG. 7 is a side view a second preferred embodiment 700 of the lifting floor 50 used for marine vessels 750 such as small craft boats and the like. Cylinders 100 and 200 can be mounted overhanging the edges of structures 780, 790 such as docks and piers that border a boat slip and the like. A reinforced thick L-shaped bracket 732, 734 formed from thick steel and the like can be used to support the bases 105, 205 of respective cylinder 100, 200. Base supports 105, 205 can be fastened to top sides the L brackets by stainless steel bolts. Likewise the L shaped brackets can be fastened to side edges of the structures 780, 790 by stainless steel bolts. Angled pivotable pads 710 and 720 can be mounted to floor 50 by bolts and the like, and can be used to support the under surface of a small craft 750.

Figure 8A:
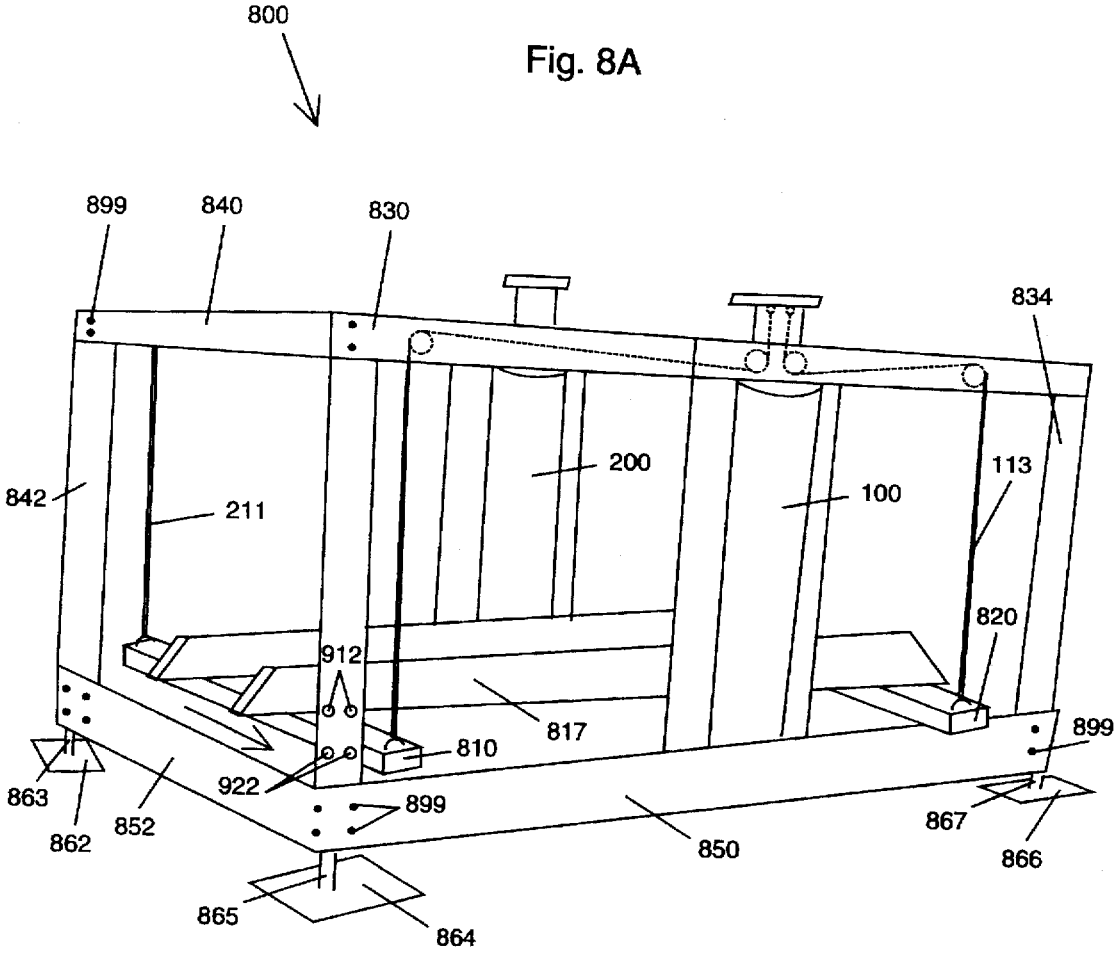
FIG. 8A is a perspective view of a third preferred embodiment of the lifting floor with separate support mount.

FIG. 8A is a perspective view of a third preferred embodiment 800 with separate support mount structure. The cylinder 100 and ropes 111 and 113 of FIGS. 1–3 is mounted in frame 830, 832 and 834. Cylinder 200 of FIG. 1 is likewise mounted separately in frame 840 which has similar frame members to frame 830 (only one side member 842 is shown. Frame members 830 and 840 are parallel to one another and can be formed from materials such as but not limited to stainless steel, galvanized steel, aluminum, fiberglass and the like, which can be alternatively connected to one another by fasteners 899 such as bolts and the like. Alternatively, the frame members can be welded to one another. The parallel frames 830 and 840 are supported by a base support 850, 852 which is supported on each of the four corners by metal pads 862, 864, 866 and 868 and height adjustable posts 863, 865, 867 and 869. Parallel board members 815 and 817 formed from wood and the like can be supported and attached to horizontal metal lifting bars 810 and 820 by fasteners such as bolts and the like. Alternatively, platform 50 of FIG. 5 with subfloor 60 of FIG. 6 can be attached to the lifting bars 810 and 820 instead of the boards 815 and 817.

Figure 8B:
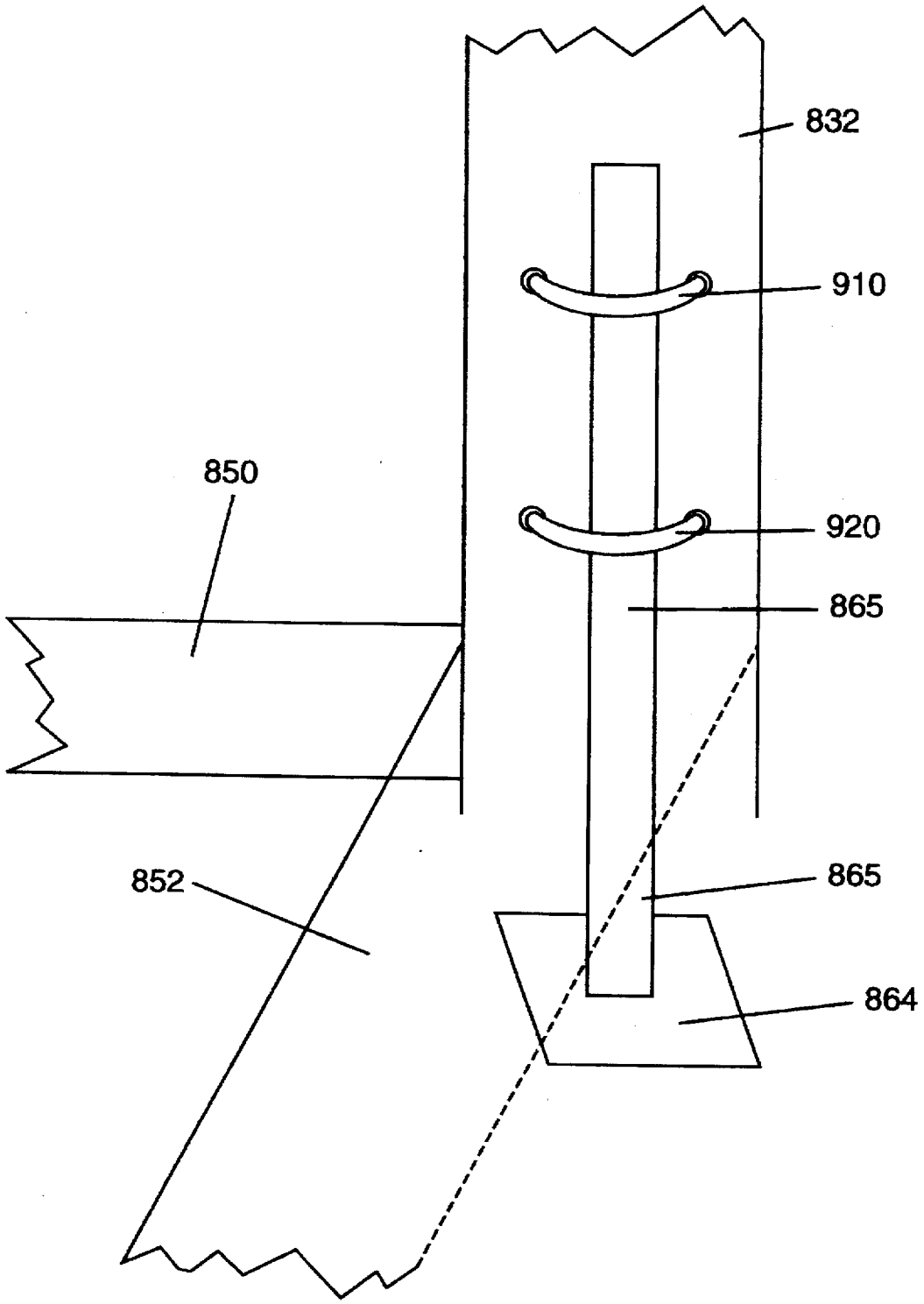
FIG. 8B is an enlarged view of a corner of the support mount of FIG. 8A along arrow E.

FIG. 8B is an enlarged view of a corner of the support mount of FIG. 8A along arrow E. While only one corner connection is shown, this description is meant to cover the other three corner connections. Metal support post 865 can be welded to a metal support pad 864. Metal U-shaped bars 910 and 920 wrap about post 865 on the inside wall 832' of member 832. The U-bolts can be fastened in their respective position by nut sets 912 and 922 shown in better detail in FIG. 8A. Loosening the nuts 912, 922 allows the posts to be vertically movable which effects the overall height of the embodiment 800. The operation of the embodiment of FIG. 8 functions in a similar manner to the embodiment of FIGS. 1–6.

Although the preferred embodiments describe the water hydraulic cylinders as being single acting by using pressurized water to raise the pistons and gravity to lower the pistons, the invention can also incorporate double acting pistons which use both pressurized water to both raise and lower the pistons.

While the embodiments of the invention above as been described has having specific materials being formed from materials such as PVC, stainless steel, and aluminum, each of the components can be formed from different variations of these components. Furthermore, other materials such as galvanized metal and the like can also be used with the subject invention.

Although the invention has been described for lifting marine animals and watercraft such as ships, the invention can be applicable to lifting other loads such as but not limited to jet skis.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A pressurized system for raising and lowering a platform in a marine environment using a city water supply comprising:

a first hydraulic cylinder having a first piston, the first piston having a first position located within the first cylinder, the first piston being vertically raisable to a second position upward from the first hydraulic cylinder;

a second hydraulic cylinder having a second piston, the second piston having a first position located within the second cylinder, the second piston being vertically raisable to a second position upward from the second hydraulic cylinder;

a platform having a first side attached to the first piston, and a second side attached to the second piston, the first cylinder positioned adjacent a mid-portion of the first side of the platform, the second cylinder positioned adjacent to a mid-portion of the second side of the platform;

a city water pressure supply that causes the first piston and the second piston to raise the platform, wherein the platform is raised above a marine environment and lowered into the marine environment by the first and the second pistons using only the city water pressure supply;

a first set of flexible lines, each having one end attached to the first piston, and each having a second end attached to a first side of the platform: and a second set of flexible lines, each having one end attached to the second piston, and each having a second end attached to a second side of the platform, wherein the first cylinder controls raising and lowering the first side of the platform and the second cylinder controls raising and lowering the second side of the platform.

2. The pressurized system of claim 1, wherein the city water pressure supply includes:

approximately 60 psi.

3. The pressurized system of claim 1, further comprising:

a grating on the platform for supporting a marine animal.

4. The pressurized system of claim 3, wherein the marine animal is chosen from at least one of:

marine mammals, aquatic animals and marine fishes.

5. The pressurized system of claim 1, further comprising:

a grating for supporting a small craft support mount.

6. The pressurized system of claim 1, further comprising:

a support means for supporting base portions of the first cylinder and the second cylinder above water level.

7. The pressurized system of claim 6, further comprising:

fasten means for supporting the base portions on a pool deck edge.

8. The pressurized system of claim 6, further comprising:

fasten means for supporting the base portions on a dock surface.

9. The pressurized system of claim 6, further comprising:

a frame support means located on a sea floor.

10. The pressurized system of claim 9, wherein the frame support further includes:

pads; and posts attached between the pads and the frame support, wherein vertically adjusting the post relative to the frame adjusts the overall height of the frame support.

11. A pressurized system for raising and lowering a platform in a marine environment that is operated by a city water pressure supply comprising:

a first hydraulic cylinder having a first piston, having a first position located within the first cylinder, the first piston being vertically raisable to a second position upward from the first hydraulic cylinder;

a second hydraulic cylinder having a second piston, the second piston having a first position located within the second cylinder, the second piston being vertically raisable to a second position upward from the second hydraulic cylinder;

a platform having openings there-through for allowing the platform to pass through a marine environment, the platform having a first side attached to the first piston, and a second side attached to the second piston, the first cylinder positioned adjacent a mid-portion of the first side of the platform, the second cylinder positioned adjacent to a mid-portion of the second side of the platform;

a city water pressure supply of approximately 60 psi;

a valve means having an open position, a closed position and an empty position, the open position of the valve means allowing pressurized water to cause the first piston and the second piston to raise the platform upwardly from the marine environment, the closed position keeping the raised platform at a selected height position, and the empty position allowing gravity to lower the platform and force the water in the first cylinder and the second cylinder to be drained to an external location;

a first set of flexible lines, each having one end attached to the first piston, and each having a second end attached to a first side of the platform; and a second set of flexible lines, each having one end attached to the second piston, and each having a second end attached to a second side of the platform, wherein the first cylinder controls raising and lowering the first side of the platform and the second cylinder controls raising and lowering the second side of the platform.

12. The pressurized system of claim 11, further comprising:

first pulley means for supporting the first set of flexible lines; and second pulley means for supporting the second set of flexible lines.

13. The pressurized system of claim 11, further comprising:

a grating on the platform for supporting a marine animal.

14. The pressurized system of claim 13, wherein the marine animal is chosen from at least one of:

whales, dolphins, manatees, walruses, hippos, sharks and stingrays.

15. The pressurized system of claim 11, further comprising:

a grating for supporting a small craft support mount.

16. The pressurized system of claim 15, wherein the small craft support mount includes:

pivotable pads for supporting a base of a boat.

17. The pressurized system of claim 11, further comprising:

a grating for supporting a jet ski.

18. A pressurized system for raising and lowering a platform in a marine environment that is operated by a city water pressure supply comprising:

a first hydraulic cylinder having a first piston with a square cross-sectional shape, the first piston being vertically raisable from the first hydraulic cylinder;

a second hydraulic cylinder having a second piston with a square cross-sectional shape, the second piston being vertically raisable from the second hydraulic cylinder;

a platform having openings there-through for allowing the platform to pass through a marine environment, the platform having a one side adjacent to the first piston, and an opposite side adjacent to the second piston;

a first set of rope lines, each having one end attached to the first piston, and each having a second end attached to the one side of the platform; and a second set of rope lines, each having one end attached to the second piston, and each having a second end attached to the opposite side of the platform, wherein the first cylinder controls raising and lowering the first side of the platform and the second cylinder controls raising and lowering the second side of the platform;

a city water pressure supply; and a valve means having an open position, a closed position and an empty position, the open position of the valve means allowing pressurized water to cause the first piston and the second piston to raise the platform upwardly from the marine environment, the closed position keeping the raised platform at a selected height position, and the empty position allowing gravity to lower the platform and force the water in the first cylinder and the second cylinder to be drained to an external location, wherein the platform moves by using only the city water pressure supply.

* * * * *